US005568862A

United States Patent [19]

Black, Jr.

[11] Patent Number: 5,568,862

[45] Date of Patent: Oct. 29, 1996

[54] PACKAGE FOR WOOD CONNECTORS AND METHOD FOR FORMING SAME

[75] Inventor: William H. Black, Jr., Edenton, N.C.

[73] Assignee: Tee-Lok Corporation, Edenton, N.C.

[21] Appl. No.: 411,294

[22] Filed: Mar. 27, 1995

[51] Int. Cl.[6] ..... B65D 71/02

[52] U.S. Cl. ..... 206/338; 206/386

[58] Field of Search ..... 206/338–348, 206/321, 386, 499, 597

[56] References Cited

U.S. PATENT DOCUMENTS

| | | | |
|---|---|---|---|
| 1,321,092 | 11/1919 | Danner | 206/499 |
| 2,545,048 | 3/1951 | Salmons | 206/499 |
| 2,788,122 | 4/1957 | Kennedy | 206/499 |
| 2,842,264 | 7/1958 | Larson | 206/499 |
| 2,988,132 | 8/1961 | Wilson | 206/499 |
| 3,032,184 | 5/1962 | Kuster | 206/499 |
| 3,352,414 | 11/1967 | Kuoni | 206/499 |
| 3,696,572 | 10/1972 | Jureit | 206/321 |
| 3,722,671 | 3/1973 | Wright | 206/499 |
| 4,314,636 | 2/1982 | Slysh | 206/321 |
| 4,427,145 | 1/1984 | Harris | 225/97 |
| 4,514,126 | 4/1985 | Knowles | 206/499 |
| 5,054,614 | 10/1991 | Glaus | 208/338 |
| 5,392,908 | 2/1995 | Black, Jr. | 206/321 |

OTHER PUBLICATIONS

Tee–Lok, Inc., Truss Plate Package Photos (1–5).

Tee–Lok Wood Connectors, 1995 Product Catalog, 32 pages.

*Primary Examiner*—Jimmy G. Foster

*Attorney, Agent, or Firm*—Bell, Seltzer, Park & Gibson, P.A.

[57] ABSTRACT

A bundle of wood connectors of the present invention comprises a plurality of wood connectors and means for connecting the wood connectors and thus for effecting unitization thereof. Each wood connector has a pair of substantially planar and generally parallel side panels, a pair of substantially planar and generally coplanar lateral panels, each of which is attached to be generally perpendicular to a respective one of the pair of side panels, and a generally planar connecting panel, with an end portion of each of the side panels being attached to a respective end portion of the connecting panel. The side panels extend from their corresponding connecting panel in a first direction. The wood connectors are arranged in nested relationship, with the side panels of adjacent wood connectors being in generally parallel relationship, and with the lateral panels of adjacent wood connectors being in generally parallel relationship. The connecting means, which is preferably an endless band that wraps tautly around the wood connectors, cooperates with the nested wood connectors to provide an easily handled unit. Preferably, the wood connector bundles are provided as a layered stack, which more preferably overlies a pallet.

27 Claims, 5 Drawing Sheets

PACKAGE FOR WOOD CONNECTORS AND METHOD FOR FORMING SAME

FIELD OF THE INVENTION

The present invention relates generally to packaging, and relates more specifically to the packaging of connectors used to join wooden planks.

BACKGROUND OF THE INVENTION

A variety of connectors are employed in the construction of homes and related structures, such as porches, decks, and the like, to join abutting wooden planks. Many of these wood connectors comprise a series of interconnected planar panels, each of which is positioned relative to its adjoining panels to either receive, overlie, and/or abut a surface of a plank. For example, one variety of joist hanger comprises a short bridging panel, a pair of side panels extending from the ends of the bridging panel and oriented to be perpendicular to the plane defined by the bridging panel, and pair of lateral panels, each of which extends outwardly from and perpendicularly to a longitudinal edge of a respective side panel. In this configuration, the joist hanger supports a T-joint between two planks. The plank having an abutting end (the abutting plank) fits within the cavity formed by the bridging panel and the side panels, with its lower surface contacting the bridging panel and its side surfaces contacting the connector side panels, and the abutting face of the other plank (the abutted plank) contacts the lateral panels. The connector is attached to the planks by nails inserted through apertures in the side and lateral panels.

Other varieties of wood connectors, such as hangers for planks formed of glued laminated wood (known as glulam hangers), strap hangers, truss hangers, I-beam hangers, and the like, are exemplified in Tee-Lok, Inc. Wood Connectors Product Catalog (1995). Each of these wood connectors is configured in such a way that a bridging or connecting panel supports a plank from beneath, side panels attach to respective side surfaces of the plank, and lateral panels attach to a surface of the joined plank on opposite sides of the abutting plank.

Wood connectors are generally packaged for use in cardboard cartons, in which large numbers of connectors are haphazardly and randomly strewn in no particular order. Wood connectors packaged in this manner can be inconvenient in several respects. First, during shipping, the wood connectors can shift relative to one another and intertwine. When a user wishes to grasp a single connector for attachment of two wooden planks, he must first separate the desired connector from any that are temporarily attached thereto by pulling, twisting or shaking the connectors. This task, which often requires the use of both hands, is complicated significantly if the user is situated on a roof or other structure that is positioned at a substantial height above the ground, as the connectors may undesirably fall from that height during disentanglement. Second, a large carton of connectors can be inconvenient to transport to and use on elevated locations on tall structures, particularly if only a few of the connectors are to be used at that location. Third, many wood connectors are formed by punching blanks from a steel sheet, then bending the blanks into the desired shape. The punching operation can create sharp edges on the panels which can easily cut the user if not handled carefully. As such, the likelihood of the user being cut or otherwise injured while disentangling a wood connector can be substantial.

Another difficulty presented by the use of wood connectors relates to identifying the proper wood connector for a particular joint at the construction site. Joints between certain planks, because of their position on a particular structure, may be required by construction code to be connected with a wood connector having at least of a minimum specified thickness, or may be required to be formed of so-called "high yield" steel. However, it is difficult to distinguish connectors of different thickness or material visually. As such, a user of the connectors is confronted with somehow properly identifying each connector as it is removed from its package prior to use and continuing to keep track of the wood connector until it is used.

In view of the foregoing, it is an object of the present invention to provide a wood connector package and an associated method for forming such a package that facilitates rapid and safe handling of wood connectors.

It is another object of the present invention to provide a wood connector package and an associated method for forming such a package that is easily transported and used when the user is positioned well off of the ground.

It is a further object of the present invention to provide a wood connector package that enables the user to easily separate one connector from the other connectors contained in the package.

It is an additional object of the present invention to provide a wood connector package that enables a user to transport and work with several connectors at once.

It is also an object of the present invention to provide a wood connector package that enables the user to identify the thickness or material type of a wood connector by rapid visual inspection.

SUMMARY OF THE INVENTION

These and other objects are satisfied by the present invention, which provides a wood connector package that facilitates handling of the connectors by the user. A bundle of wood connectors of the present invention comprises a plurality of wood connectors and means for connecting the wood connectors and thus for effecting unitization thereof. Each wood connector has a pair of substantially planar and generally parallel side panels, a pair of substantially planar and generally coplanar lateral panels, each of which is attached to be generally perpendicular to a respective one of the pair of side panels, and a generally planar connecting panel, with an end portion of each of the side panels being attached to a respective end portion of the connecting panel. The side panels extend from their corresponding connecting panel in a first direction. The wood connectors are arranged in nested relationship, with the side panels of adjacent wood connectors being in generally parallel relationship, and with the lateral panels of adjacent wood connectors being in generally parallel relationship. The connecting means, which is preferably an endless band that wraps tautly around the wood connectors, cooperates with the nested wood connectors to provide an easily handled unit. It is also preferred that the connecting bands for wood connectors of different thickness and material types be different colors, thereby enabling the user to rapidly identify the proper wood connector for use on a particular joint.

In a preferred embodiment, the wood connector bundles of the present invention are provided as a stack of wood connector bundles, and it is more particularly preferred that the stack be part of a wood connector bundle package that includes an underlying pallet. The stack includes a plurality of layers of wood connector bundles and sheet material between at least one, and preferably each of, the wood connector bundle layers. Such a stack is self-supporting, even as wood connector bundles and layers thereof are removed, which facilitates transport, storage and use of the stack in production.

Another aspect of the present invention is a method of interconnecting wooden planks with wood connectors. Each of the wood connectors has pair of substantially planar and generally parallel side panels, a pair of substantially planar and generally coplanar lateral panels, each of which is attached to be generally perpendicular to a respective one of the pair of side panels, and a generally planar connecting panel, with an end portion of each of the side panels being attached to a respective end portion of the connecting panel. The side panels extend from their corresponding connecting panel in a first direction. The wood connectors are provided in first and second wood connector bundles. The first wood connector bundle comprises a first plurality of wood connectors having a first thickness and being formed of a first material type, wherein the first plurality of wood connectors are arranged in a nested configuration, with the side panels of adjacent first wood connectors being in generally parallel relationship, and with the lateral panels of adjacent first wood connectors being in generally parallel relationship. The first wood connector bundle further includes a first connecting band cooperating with the first plurality of nested wood connectors for effecting unitization thereof. The first connecting band includes first visual indicia corresponding to the first thickness and the first material type. The second wood connector bundle is similarly constructed of a second plurality of wood connectors, which wood connectors have a second thickness and a second material type, at least on of which differs from the first thickness and the first material type. The second plurality of wood connectors is interconnected with a second connecting band which includes second visual indicia corresponding to the second thickness and material type. The second visual indicia differs from the first visual indicia. The method comprises the steps of: providing a first pair of wooden planks; identifying the first wood connector bundle; interconnecting the first pair of wooden planks with one of the first plurality of wood connectors; providing a second pair of wooden planks; identifying the second wood connector bundle; and interconnecting the second pair of wooden planks with one of the second plurality of wood connectors.

Preferably, the first and second connecting bands are formed in different colors. Using different colored bands enables the thickness and material composition of the wood connectors comprising the first and second wood connector bundles to be identified rapidly, even at a distance.

DETAILED DESCRIPTION OF THE PREFERRED EMBODIMENTS OF THE INVENTION

The present invention will be described more particularly more hereinafter with reference to the accompanying drawings. The invention is not intended to be limited to the illustrated embodiments; rather, these embodiments are intended to fully and completely disclose the invention to those skilled in this art.

Figure 1:
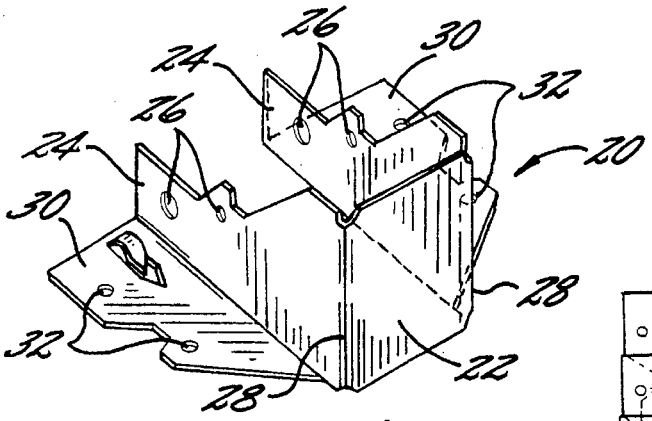
FIG. 1 is a perspective view of a wood connector typically used to support floor joists and roof trusses.

Referring now to the drawings, FIG. 1 illustrates a joist hanger broadly designated at 20. The joist hanger 20 comprises a connecting panel 22, a pair of side panels 24, and a pair of lateral panels 30. The connecting panel 22, which is generally planar, is fixed at each end portion 28 to a side panel 24. The side panels 24 are generally parallel, and preferably substantially parallel, to each other and extend generally perpendicularly, and preferably substantially perpendicularly, from respective ends of the connecting panel 22 in the same direction. Each lateral panel 30 is fixed to the longer longitudinal edge of a corresponding side panel 24 and extends generally perpendicularly thereto to be generally coplanar with the other lateral panel 30.

The joist hanger 20 is preferably formed of galvanized steel having a thickness of between about 12 and 20 gauge (between about 0.105 and 0.036 inches), although those skilled in this art can appreciate that other metals, or even other materials, can be used to form the joist hanger 20. It is also preferred that the joist hanger 20 be formed by stamping a blank from sheet metal, then bending the blank to form the connecting panel 22, the side panels 24, and the lateral panels 30. Those skilled in this art will also appreciate that the panels comprising the joist hanger 20 can take any number of dimensions, as illustrated in the 1995 *Product Catalog, Tee-Lok Wood Connectors* at page 6.

Those skilled in this art will appreciate that the joist hanger 20 can be used to interconnect one end of a first wooden plank to an abutting face of a second plank. When connected, the connecting panel 22 underlies the abutting end of the first plank. The side panels 24 rest against and are fixed to the lateral surfaces of the first plank via nails or other fasteners inserted through apertures 26 located in the side panels 24. The lateral panels 30 rest against to the portions of the abutting face of the second plank on opposite sides of the first plank; the lateral panels 30 are fixed thereto via nails or other fasteners inserted through apertures 32. In such a configuration, the joist hanger 20 supports and interconnects the first and second planks.

Figure 2:
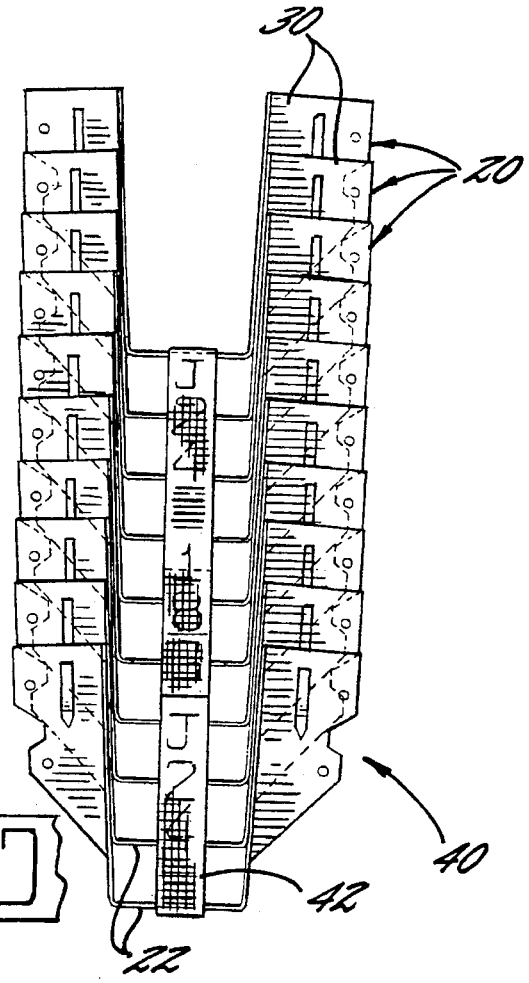
FIG. 2 is a top view of a wood connector bundle of the present invention.
Figure 2A:
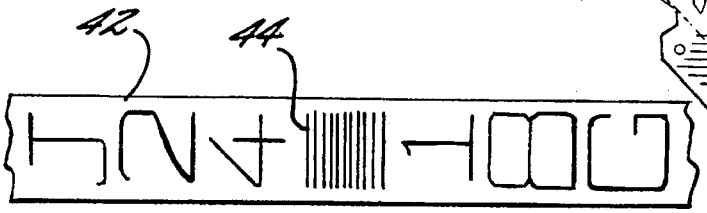
FIG. 2A is an enlarged view of the connecting band of the wood connector bundle of FIG. 2.
Figure 3:
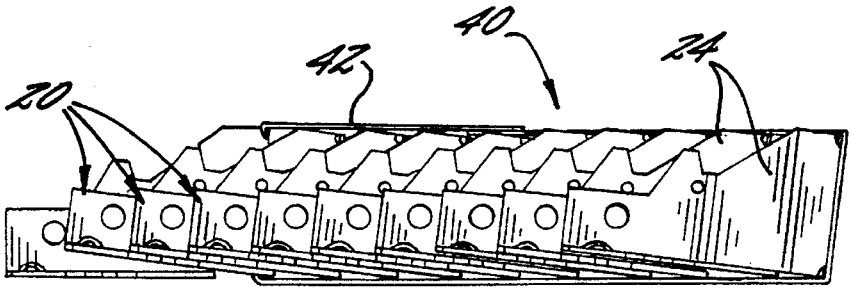
FIG. 3 is a side view of the wood connector bundle of FIG. 2.

Referring now to FIGS. 2 and 3, the joist hangers 20 of FIG. 1 can be advantageously packaged in a joist hanger bundle 40, which comprises a plurality of joist hangers 20 and a connecting band 42. The joist hangers 20 are arranged in a nested configuration, in which the side panels 24 of adjacent joist hangers 20 are in generally parallel, generally contacting, and partially overlying relationship, the lateral panels 30 of adjacent joist hangers 20 are in generally parallel, generally contacting, and partially overlying relationship, and the connecting panels 22 of adjacent joist hangers 20 are in generally parallel and spaced-apart relationship. The endless connecting band 42 loops tautly around the connecting panels 22 of the joist hangers 20, with substantial portions of the connecting band 42 extending in the same direction as the side panels 24 relative to the connecting panels 22, to effect unitization of the joist hangers 20 into the wood connector bundle 40.

It should be understood that, although the disposition of the endless band 42 relative to the connector panels 22 is preferred, the endless band 42 can also be disposed to extend transversely across the side panels 24 and lateral panels 30, or in any other disposition that interconnects the joist hanger 20. Those skilled in this art will further appreciate that, although the endless band 42 illustrated herein is preferred, any number of means for connecting the joist hangers 20 into a unitized wood connector bundle 40 can be used with the present invention. Alternative connecting means include heat-shrinkable polymeric sheet material that encloses most or all of the joist hangers 20 comprising the bundle 40, wire or other filamentous material that encircles adjacent panels of adjacent connectors, other strip-like material that encircles adjacent panels of adjacent connectors, and the like. It should also be understood that, although ten joist hangers 20 are illustrated in the joist hanger bundle 40, any number of joist hangers 20 that renders the bundle 40 convenient to handle can be included therein.

Figure 4:
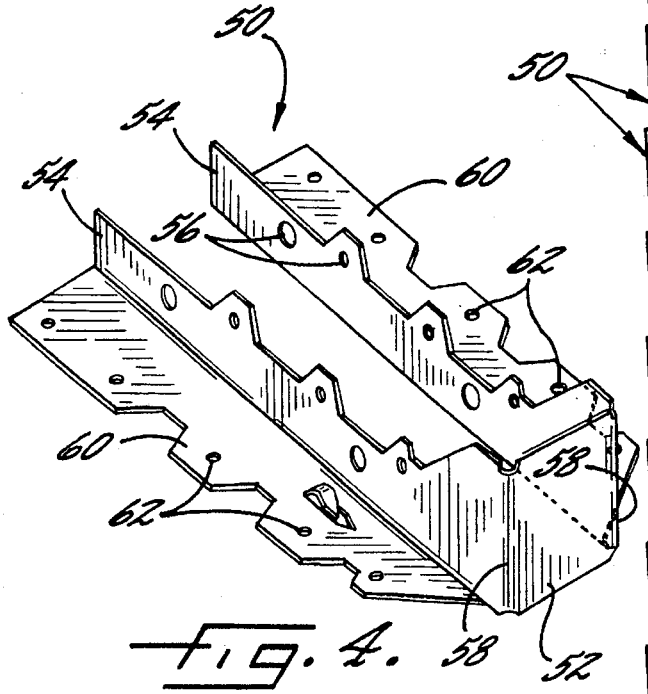
FIG. 4 is a perspective view of a larger joist hanger.

A large joist hanger, broadly designated at 50, is illustrated in FIG. 4. The large joist hanger 50 comprises a connecting panel 52, a pair of side panels 54, and a pair of lateral panels 60. The connecting panel 52, which is generally planar, is fixed at each end portion 58 to a side panel 54. The side panels 54 are generally parallel, and preferably substantially parallel, to each other and extend generally perpendicularly, and preferably substantially perpendicularly, from the connecting panel 52 in the same direction. Each lateral panel 60 is fixed to a longitudinal edge of a corresponding side panel 54 and extends generally perpendicularly thereto to be generally coplanar with the other lateral panel 60.

The large joist hanger 50 is preferably formed of galvanized steel having a thickness of between about 12 and 20 gauge (between about 0.105 and 0.036 inches), although those skilled in this art can appreciate that other metals, or even other materials, can be used to form the large joist hanger 50. It is also preferred that the large joist hanger 50 be formed by stamping a blank from sheet metal, then bending the blank to form the connecting panel 52, the side panels 54, and the lateral panels 60. Those skilled in this art will also appreciate that the panels comprising the large joist hanger 50 can take any number of dimensions, as illustrated in the 1995 *Product Catalog, Tee-Lok Wood Connectors* at page 7.

The large joist hanger 50 interconnects wooden planks in much the same way as the joist hanger 20 illustrated in FIG. 1. In interconnecting one end of a first plank to an abutting face of a second plank, the connecting panel 52 underlies the abutting end of the first plank. The side panels 54 rest against and are fixed to the lateral surfaces of the first plank via nails or other fasteners inserted through apertures 56 located in the side panels 54. The lateral panels 60 rest against the portions of the abutting face of the second plank on opposite sides of the first plank; the lateral panels 60 are fixed thereto via nails or other fasteners inserted through apertures 62.

Figure 5A:
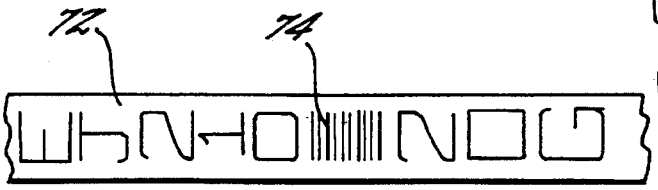
FIG. 5A is an enlarged view of the connecting band of the wood connector bundle of FIG. 2.
Figure 5:
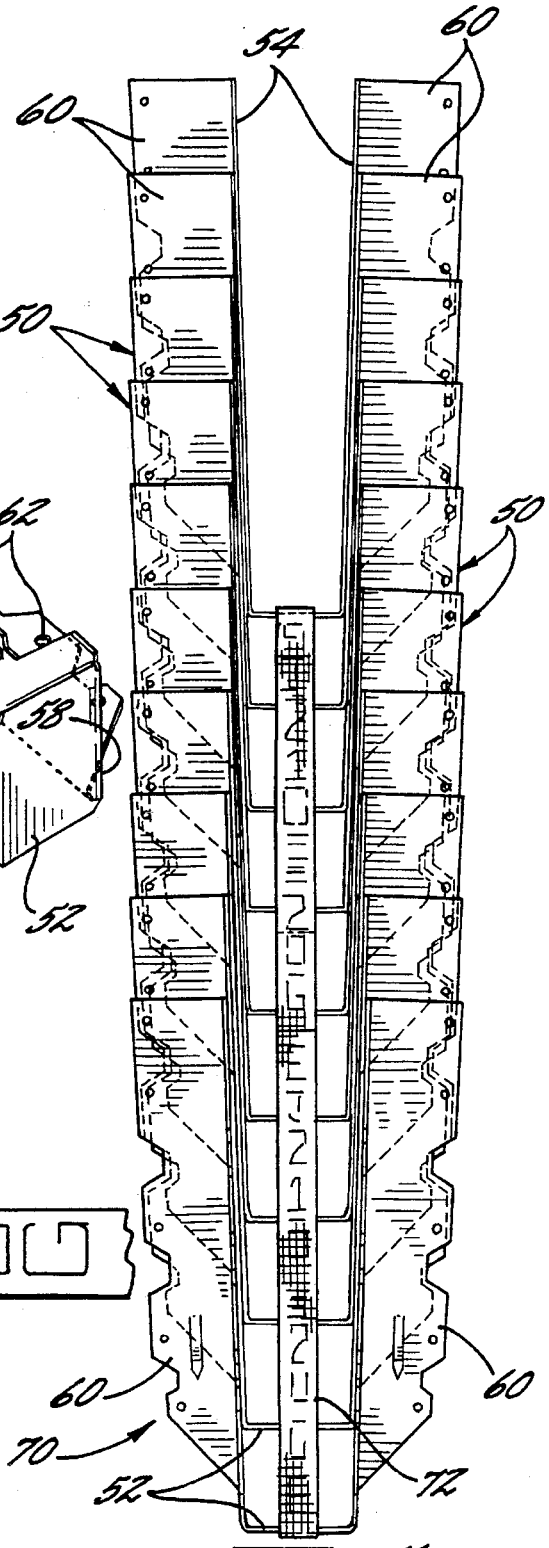
FIG. 5 is a top view of a bundle of the joist hangers of FIG. 4.

A large joist hanger bundle 70 is illustrated in FIG. 5. The large joist hanger bundle 70 comprises a plurality of large joist hangers 50 and a connecting band 72. The large joist hangers 50 are arranged in a nested configuration, in which the side panels 54 of adjacent large joist hangers 50 are in generally parallel, generally contacting, and partially overlying relationship, the lateral panels 60 of adjacent large joist hangers 50 are in generally parallel, generally contacting and partially overlying relationship, and the connecting panels 52 of adjacent large joist hangers 50 are in generally parallel and spaced apart relationship. The endless connecting band 72 loops tautly around the connecting panels 52 of the large joist hangers 50, with substantial portions of the connecting band 72 extending in the same direction as the side panels 54 relative to the connecting panels 52, to effect unitization of the large joist hangers 50 into the wood connector bundle 70.

It should be understood that, although the disposition of the endless band 72 relative to the connector panels 52 is preferred, the endless band 72 can also be disposed to extend transversely across the side panels 54 and lateral panels 60, or in any other disposition that interconnects the joist hanger 50. Those skilled in this art will appreciate that, although the endless band 72 illustrated herein is preferred, any number of means for connecting the large joist hangers 50 into a unitized large joist hanger bundle 70 can be used with the present invention. Alternative connecting means include heat-shrinkable polymeric sheet material that encloses most or all of the large joist hangers 50 comprising the bundle 70, wire or other filamentous material that encircles adjacent panels of adjacent large joist hangers 50, other strip-like material that encircles adjacent panels of adjacent large joist hangers 50, and the like. It should also be understood that, although ten large joist hangers 50 are illustrated in the large joist hanger bundle 70, any number of large joist hangers 50 that renders the bundle 70 convenient to handle can be included therein.

Figure 6:
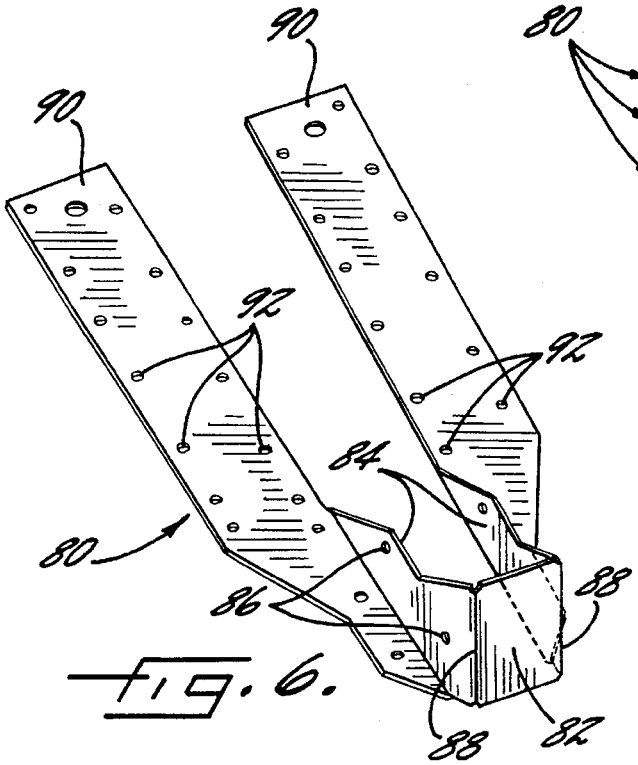
FIG. 6 is a perspective view of a strap hanger for roof trusses, floor trusses, and beams.

Referring now to FIG. 6, a strap hanger 80 comprises a connecting panel 82, a pair of side panels 84, and a pair of lateral panels 90. The connecting panel 22, which is generally planar, is fixed at each end portion 88 to a side panel 84. The side panels 84 are generally parallel to each other and extend generally perpendicularly from respective ends of the connecting panel 82 in the same direction. Each lateral panel 90 is fixed to a longitudinal edge of a corresponding side panel 84 and extends generally perpendicularly thereto to be generally coplanar with the other lateral panel 90.

The strap hanger 80 is preferably formed of galvanized steel having a thickness of between about 12 and 20 gauge (between about 0.105 and 0.036 inches), although those skilled in this art can appreciate that other metals, or even other materials, can be used to form the strap hanger 80. It is also preferred that the strap hanger 80 be formed by stamping a blank from sheet metal, then bending the blank to form the connecting panel 82, the side panels 84, and the lateral panels 90. Those skilled in this art will also appreciate that the panels comprising the strap hanger 80 can take any number of dimensions, as illustrated in the 1995 *Product Catalog, Tee-Lok Wood Connectors* at page 8.

Those skilled in this art will appreciate that the strap hanger 80 can be used to interconnect wooden planks in much the same manner as the joist hanger 20 illustrated in FIG. 1 and the large joist hanger 50 illustrated in FIG. 4. One difference, however, between the strap hanger 80 and the earlier illustrated wood connectors is that the lateral panels 90 are of sufficient length that the ends thereof opposite the connecting panel 82 can extend beyond the height of the second plank. As such, they can be bent downwardly to rest atop the top face of the second plank. Once so bent, they can be fixed thereto via nails or other threaded fasteners, thereby providing additional reinforcement to the joint.

Figure 7A:
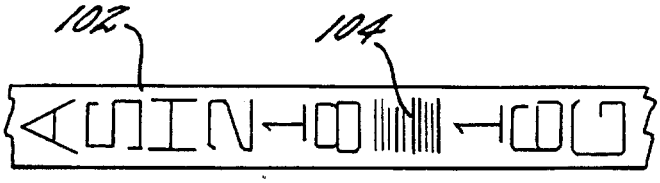
FIG. 7A is an enlarged view of the connecting band of the wood connector bundle of FIG. 2.
Figure 7:
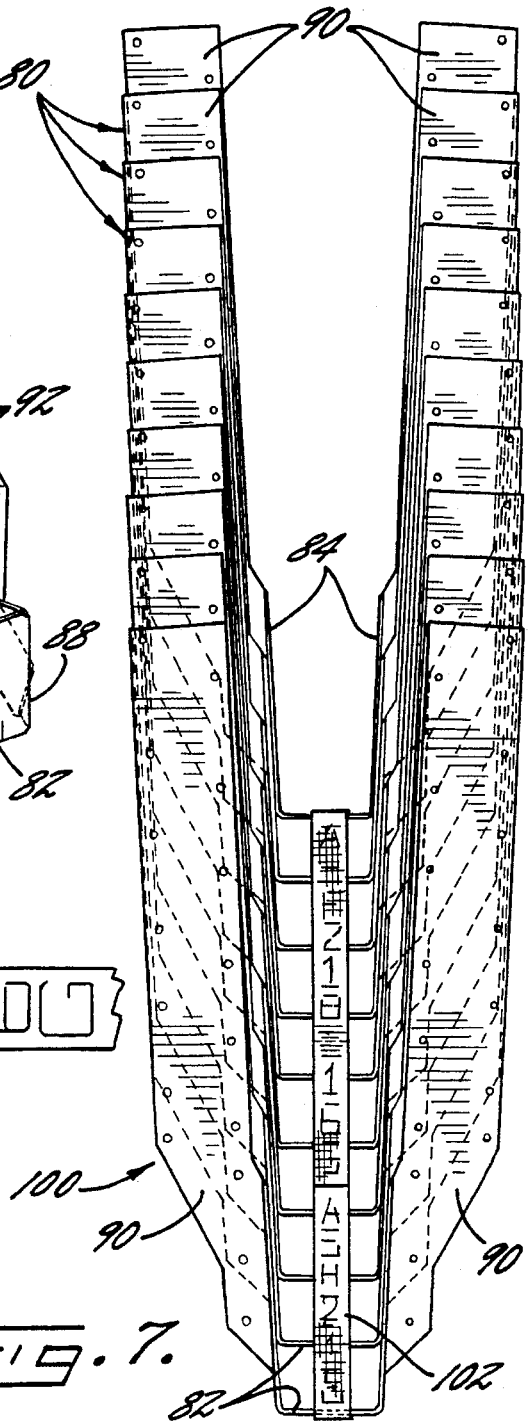
FIG. 7 is a top view of a wood connector bundle of the present invention that includes a plurality of strap hangers like that shown in FIG. 6.

FIG. 7 illustrates a strap hanger bundle 100, which comprises a plurality of strap hangers 80 and a connecting band 102. The strap hangers 80 are arranged in a nested configuration, in which the side panels 84 of adjacent strap hangers 80 are in generally parallel, generally contacting, and partially overlying relationship, the lateral panels 90 of adjacent strap hangers 80 are in generally parallel, generally contacting, and partially overlying relationship, and the connecting panels 82 of adjacent strap hangers 80 are in generally parallel and spaced-apart relationship. The endless connecting band 102 loops tautly around the connecting panels 82 of the strap hangers 80 to effect unitization of the strap hangers 80 into a bundle 100.

It should be understood that, although the disposition of the endless band 102 relative to the connector panels 82 is preferred, the endless band 102 can also be disposed to extend transversely across the side panels 84 and lateral panels 60, or in any other disposition that interconnects the joist hanger 80. Those skilled in this art will appreciate that, although the endless band 102 illustrated herein is preferred, any number of means for connecting the strap hangers 80 into a unitized strap hanger bundle 100 can be used with the present invention. Alternative connecting means include heat-shrinkable polymeric sheet material that encloses most or all of the strap hangers 80 comprising the bundle 100, wire or other filamentous material that encircles adjacent panels of adjacent strap hangers 80, other strip-like materials that encircles adjacent panels of adjacent strap hangers 80, and the like. It should also be understood that, although ten strap hangers 80 are illustrated in the strap hanger bundle 100, any number of strap hangers 100 that renders the bundle 100 convenient to handle can be included therein.

It should also be understood that the present invention is suitable for use with other varieties of wood connectors that include a pair of generally parallel side panels connected to a connecting panel and a pair of generally coplanar lateral panels connected to and extending laterally from the side panels. Exemplary alternative wood connectors, including truss hangers, hip and jack hangers, I-beam hangers, adjustable rafter ties, variable pitch rafter plates, LVL and parallam hangers (both top mount and face mount), and glulam hangers (both top mount and face mount), are illustrated in the 1995 *Product Catalog, Tee-Lok Wood Connectors.* Those skilled in this art will recognize that the present invention is suitable for certain wood connectors, such as top mount LVL, parallam, and glulam hangers, that include top mounting panels extending from the lateral panels in a direction away from the connecting panel. In addition, those skilled in this art will appreciate that wood connectors in which the side panels are generally parallel, the lateral panels are generally coplanar, but the side and lateral panels are not perpendicular, such as skewed joist hangers, can also be formed into a wood connector bundle of the present invention. Further, wood connectors such as adjustable rafter ties, in which the connecting panel is nonperpendicular to the side panels, can also be formed into a wood connector bundle of the present invention.

Figure 8:
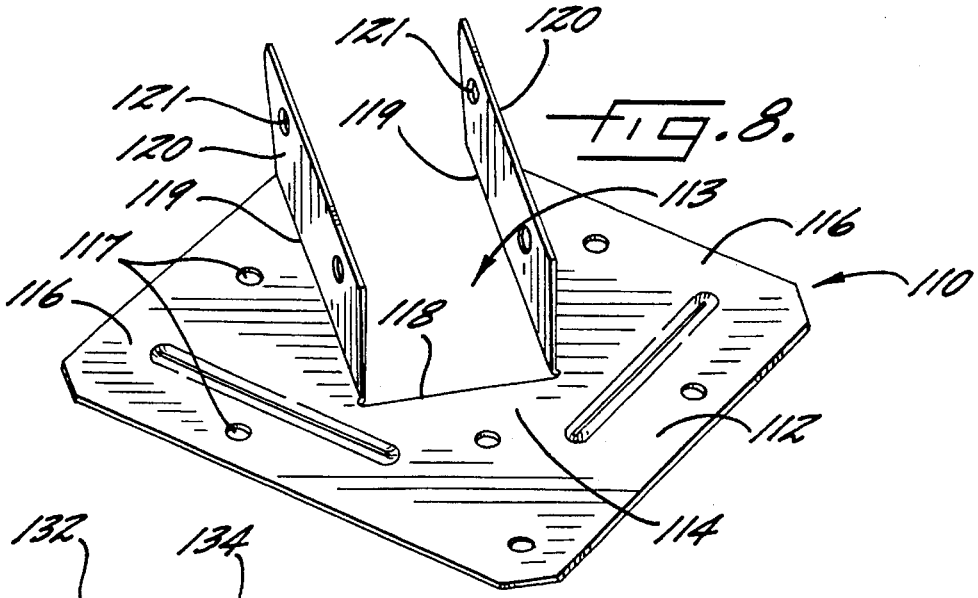
FIG. 8 is a perspective view of a hurricane anchor used to anchor rafters, joists and trusses to wall plates, headers, and beams.
Figure 9A:
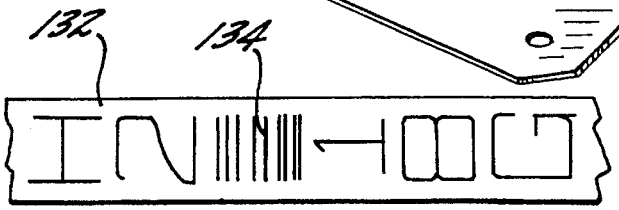
FIG. 9A is an enlarged view of the connecting band of the wood connector bundle of FIG. 2.
Figure 9:
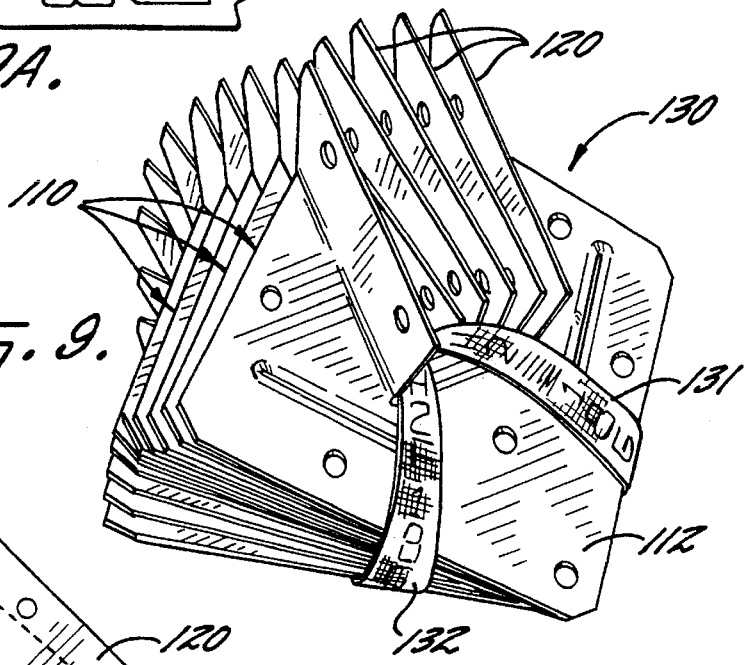
FIG. 9 is a perspective view of a wood connector bundle of the present invention that includes a plurality of hurricane anchors such as that shown in FIG. 8.
Figure 10:
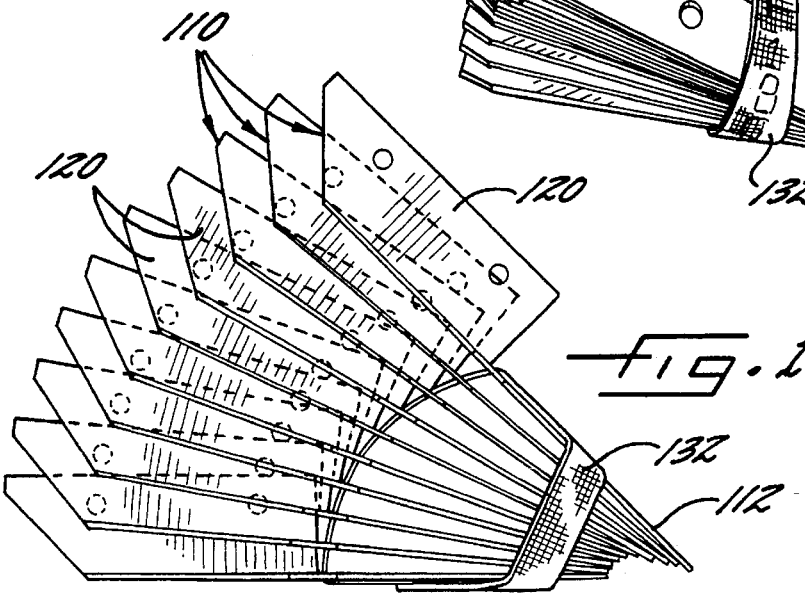
FIG. 10 is a side view of the wood connector bundle of FIG. 9.

An additional embodiment of the present invention is illustrated in FIGS. 8 through 10. A hurricane anchor, designated broadly at 110, is illustrated in FIG. 8. The hurricane anchor 110 comprises a substantially diamond-shaped flat panel 112 having a generally rectangular cutaway portion 113 having an open end. The flat panel 112 comprises a connecting portion 114 adjacent the closed end of the cutaway portion 113 and a pair of lateral portions 116 adjacent opposite sides of the cutaway portion 113. The connecting portion 114 includes apertures 115, and the lateral portions 116 include apertures 117; the apertures 115, 117 are sized and configured to receive nails or other fasteners as the hurricane anchor 110 is fixed to adjoining wood planks. The connecting portion 114 further includes an edge 118 that defines the closed end of the cutaway portion 113. Similarly, each lateral portion 116 includes an edge 119 that defines the longitudinal edges of the cut away portion 113. Each of the side panels 120 originates from a lateral portion edge 119 and extends generally perpendicularly therefrom. Each of the side panels 120 includes apertures 121 sized to receive nails or other fasteners.

Those skilled in this art will appreciate that the hurricane anchor 110 can be used to interconnect wooden planks, and in particular is configured to interconnect a rafter directly to a crossbeam. The connecting portion 114 rests against and is fixed via nails or other fasteners to the wall stud. The rafter is received within the cut away portion 113 so that the side panels 120 rest against and are fixed to opposite faces thereof.

FIGS. 9 and 10 illustrate a hurricane anchor bundle 130, which comprises a plurality of hurricane anchors 110 and a pair of connecting bands 131, 132. The hurricane anchors 110 are nested such that each flat panel 112 is in generally parallel, generally spaced apart, and substantially overlying relationship with the flat panel 112 of an adjacent hurricane anchor 110. Each side panel is in generally parallel, partially overlying, and contacting relationship with a side panel 120 of at least one adjacent hurricane anchor 110. The endless connecting bands 131, 132 loop from opposite corners of the cut away portion 113 to opposite edges of flat panels 112 to unitize the hurricane anchors 110 into an easily handled bundle 130.

It should also be noted that the connecting bands 42, 72, 102, 131, 132 of the wood connector bundles 40, 70, 100, 130 can be colored-coded to enable one working with the bundles to easily distinguish wood connector sizes and types from one another (see FIGS. 2A, 5A, 7A, and 9A). Preferably, wood connectors having one predetermined thickness can be connected with a connecting band of one color, while wood connectors having different thicknesses can be connected with connecting bands of different colors. For example, wood connectors formed of 20 gauge steel can be connected with a white band, those formed of 18 gauge steel can be connected with a red band, those formed of 16 gauge steel can be connected with a black band, and those formed of high yield steel (i.e., having a yield strength of about 60 ksi) can be connected with a yellow band. Bundles having connecting bands that are so colored can be quickly identified from a distance by one having knowledge of the color identification system. Such identification can be difficult otherwise because wood connectors formed of steel of different thickness or material composition are visually virtually identical. As exemplified in FIG. 2A, the thickness (20 gauge) of the material and wood connector model of the wood connectors 20 comprising the wood connector bundle 40 are imprinted in the connecting band 42. Also, optically readable encoded pattern 44 (such as a "bar code") indicating the model, thickness, and material composition of the wood connectors 20 is included in the connecting band 42. The wood connector bundles 70, 100, 130 are similarly identified as shown in FIGS. 5A, 7A, and 9A with, respectively, optically readable patterns 74, 104 and 134. As a result of improved identification a user can easily identify the proper wood connectors to be used to interconnect specific pairs of planks, which can later be interconnected with one another. It is intended that the interconnection of one interconnected plank pair with a second interconnected plank pair encompasses the incorporation of these plank pairs into a single integrated structure (such as a house) whether the first and second plank pairs are interconnected directly (i.e., in contact with one another) or indirectly (i.e., with other planks or other structures providing a bridge there between).

Figure 11:
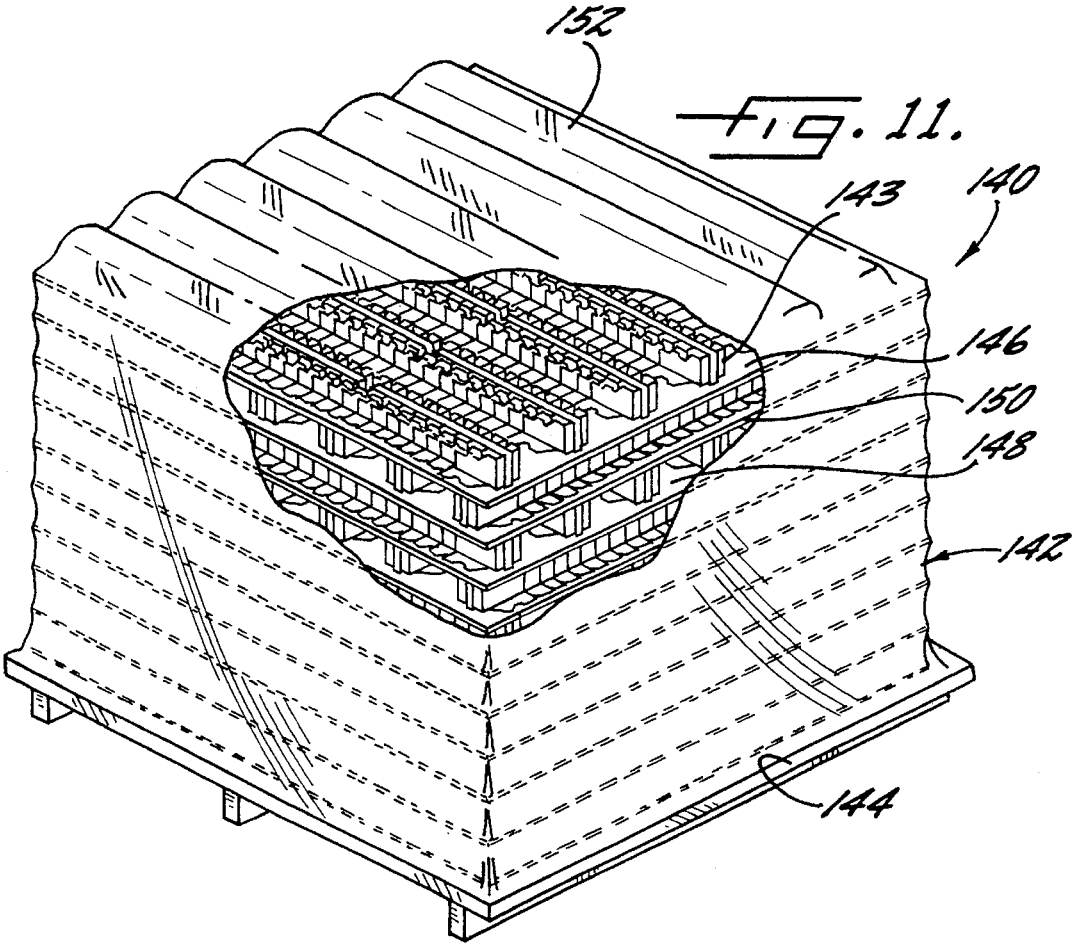
FIG. 11 is a perspective view of a package of wood connector bundles according to the present invention.
Figure 12:
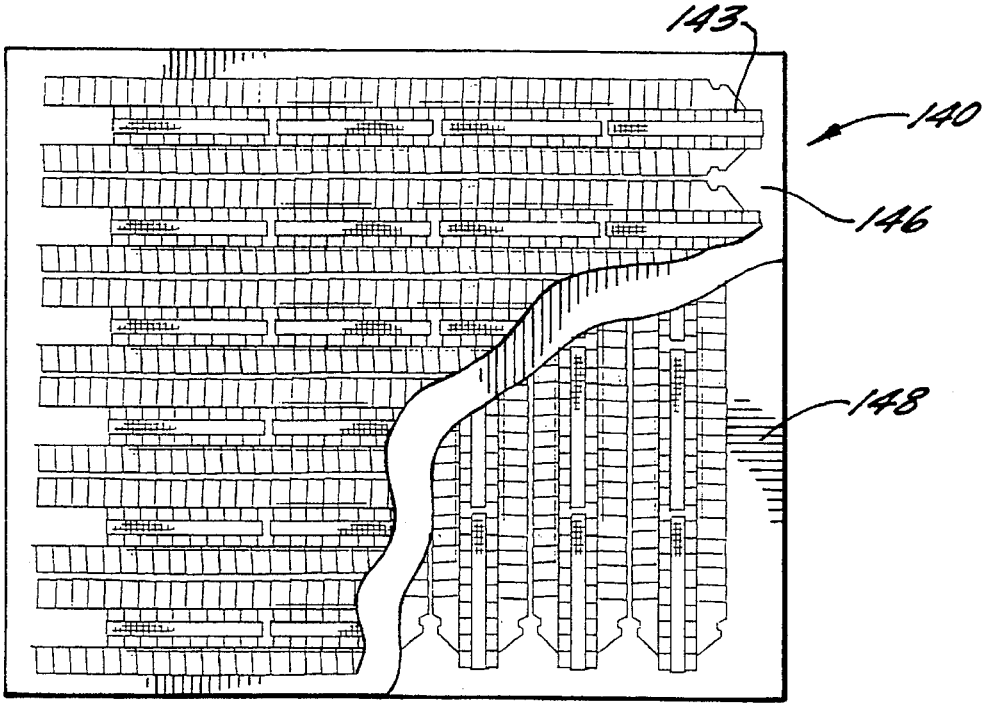
FIG. 12 is a partial cutaway top view of the wood connector bundle package of FIG. 11.

FIGS. 11 and 12 illustrate a package 140 of wood connector bundles of the configuration shown in FIGS. 2 through 4. The wood connector bundle package 140 comprises a pallet 144 underlying a stack 142 of wood connector bundles 143. The wood connector bundles are arranged in a plurality of overlying stacked layers (two of which are indicated as 146 and 148 in FIGS. 11 and 12) separated by a sheet material 150. Each of the layers 146, 148 comprises a plurality of wood connector bundles 143. The sheet material 150, which preferably is formed of cardboard, can be any sheet material that is sufficiently durable to separate the wood connector bundle layers 146, 148. The stack 142 is illustratively and preferably enclosed within a wrapper 152 formed of a heat shrinkable polymeric sheet material, but can be enclosed with any means, such as a cardboard packaging carton or the like, that encloses the stack 142.

The stack 142 is sufficiently stable that it can be entirely self-supporting. As a result, when the wrapper 152 is removed, the stack 142 does not collapse or topple, but instead remains standing.

The ability of the stack 142 to remain erect when free-standing provides tremendous advantages in the shipping, storage, and handling of wood connectors. First, because the stack 142 does not collapse, it can be formed on an underlying pallet 144 by the manufacturer, enclosed within a wrapper 152 or other enclosing means, and shipped in this form to a distant location. Once there, the wrapper 152 can be removed and discarded without disturbing the stack 142. Also, when the stack 142 is maintained on a pallet 144, it can be moved about the facility with a forklift or other pallet-transporting means. In contrast, wood connectors packed randomly in cartons are not shipped in enclosures having an underlying pallet. The haphazard distribution of truss plates precludes the use of a polymeric film wrapper like that illustrated at 152 in FIG. 11; thus some other enclosing means, such as a cardboard carton, would be required. Generally, pallet cartons are sufficiently large that items contained therein cannot be accessed easily without removing the carton walls. Such removal would cause wood connectors randomly packed in a carton to spill from the carton, thereby creating unkempt and even hazardous conditions. As a result, randomly packed wood connectors are packaged in much smaller boxes sized to permit easy removal of the wood connectors therefrom. The material comprising the enclosing container to must be disposed of somehow; however, the waste created by a single sheet of polymer film or a single carton attached to a pallet and the sheet material that separates the wood connector bundle layers is considerably less than that created by the numerous smaller cartons required to ship a similar number of wood connectors. Thus the capability of packaging wood connectors in a large pallet configuration, which ability is a result of the present invention, decreases the user's waste disposal costs significantly.

Second, by forming the wood connectors into bundles that are then stacked as shown in FIGS. 11 and 12, packaging density can be increased substantially. For example, a cardboard carton measuring 18 inches by 8 inches by 6½ inches can hold about 50 randomly packed joist hangers, which together weigh about 20 pounds. Approximately 120 boxes of this size can be arranged to occupy the same volume as that of a single pallet and wrapper measuring 48 inches by 48 inches by 48 inches. The 120 randomly packed boxes contain approximately 2400 pounds of joist hangers, while the same volume of stacked joist hangers weighs between about 4000 and 5000 pounds. As a result, the storage space requirements for a stack of joist hangers, which can affect both transportation and inventory costs, are considerably less than those for randomly packed wood connectors.

Third, the stack 142 can be slowly disassembled by removing one or more joist hanger bundles 143 without the entire stack 142 collapsing. This saves time in the accessing and handling of wood connectors, as the user need not take the time to open a box, place it in a convenient location, and reach in and gather joist hangers; instead, a bundle can be removed from the stack as needed.

Finally, the wood connector bundles 40, 70, 100, and 130 illustrated in FIGS. 2, 3, 5, 7, and 10 provide a unit that is easily handled. One or more bundles can be easily transported to an elevated location, where the individual connectors can be rapidly disassembled for use without undue twisting or shaking. The relatively predictable release of an individual connector for the bundle reduces the probability of injury to the user.

The foregoing embodiments are illustrative of the present invention, and are not to be construed as limiting thereof. The invention is defined by the following claims, with equivalents of the claims to be included therein.

That which is claimed is:

1. A bundle of wood connectors, comprising:

a plurality of wood connectors, wherein each wood connector has a pair of substantially planar and generally parallel side panels, a pair of substantially planar and generally coplanar lateral panels, each of which is attached to be generally perpendicular to a respective one of said pair of side panels, and a generally planar connecting panel, with an end portion of each of said side panels being attached to a respective end portion of said connecting panel, the side panels extending from their corresponding connecting panel in a first direction, and with said wood connectors being arranged in nested relationship, with the side panels of adjacent wood connectors being in generally parallel relationship, and with the lateral panels of adjacent wood connectors being in generally parallel relationship, wherein at least one of said side panels and said lateral panels includes a plurality of apertures sized and positioned to receive nails: and connecting means cooperating with said plurality of nested wood connectors for effecting unitization thereof.

2. A bundle of wood connectors defined in claim 1, wherein said side panels of adjacent wood connectors are in partially overlying relationship.

3. A bundle of wood connectors defined in claim 1, wherein said lateral panels of adjacent wood connectors are in partially overlying relationship.

4. A bundle of wood connectors defined in claim 1, wherein each of said connecting panels is generally perpendicular to each of said pair of side panels and to each of said pair of lateral panels.

5. A bundle of wood connectors defined in claim 4, wherein each of said connecting panels is spaced away from the connecting panels of an adjacent wood connector.

6. A bundle of wood connectors defined in claim 4, wherein said connecting means comprises a band encircling said wood connectors.

7. A bundle of wood connectors defined in claim 6, wherein said band is wrapped around said connecting panels, with substantial portions of said band extending generally in said first direction.

8. A bundle of wood connectors defined in claim 4, wherein each of said wood connectors further comprises a pair of overlap panels, each of which is attached to a respective one of said lateral panels and extends therefrom generally parallel to said connecting panel.

9. A bundle of wood connectors defined in claim 1, wherein each of said connecting panels is generally coplanar with and contiguously merges with each of its corresponding lateral panels.

10. A bundle of wood connectors defined in claim 9, wherein said connecting means comprises at least one band encircling said nested connectors.

11. A bundle of wood connectors defined in claim 10, wherein said connecting means comprises two bands encircling said connectors.

12. A bundle of wood connectors, comprising:

a plurality of wood connectors, wherein each wood connector has a pair of substantially planar and generally parallel side panels, a pair of substantially planar and generally coplanar lateral panels, each of which is attached to a respective one of said pair of side panels, and a generally planar connecting panel that is generally perpendicular to said side panels and said lateral panels, with an end portion of each of said side panels being attached to a respective end portion of said connecting panel, and with the side panels extending from their corresponding connecting panel in a first direction, said wood connectors being arranged in nested relationship, with the side panels of adjacent wood connectors being in generally parallel contacting relationship, and with the lateral panels of adjacent wood connectors being in generally parallel and contacting relationship; and connecting means cooperating with said plurality of nested wood connectors for effecting unitization thereof.

13. A bundle of wood connectors defined in claim 12, wherein said side panels of adjacent wood connectors are in partially overlying relationship.

14. A bundle of wood connectors defined in claim 12, wherein said lateral panels of adjacent wood connectors are in partially overlying relationship.

15. A bundle of wood connectors defined in claim 14, wherein said connecting means comprises a band encircling said wood connectors.

16. A bundle of wood connectors defined in claim 15, wherein said band is wrapped around said connecting panels, with substantial portions of said band extending generally in said first direction.

17. A bundle of wood connectors defined in claim 12, wherein at least one of said side panels and said lateral panels includes a plurality of apertures sized and positioned to receive nails.

18. A stack of wood connector bundles, comprising:

a plurality of connector bundles, each of said connector bundles comprising:

a plurality of wood connectors, wherein each wood connector has a pair of substantially planar and generally parallel side panels, a pair of substantially planar and generally coplanar lateral panels, each of which is attached to be generally perpendicular to a respective one of said pair of side panels, and a generally planar connecting panel, with an end portion of each of said side panels being attached to a respective end portion of said connecting panel, the side panels extending from their corresponding connecting panel in a first direction, and with said wood connectors being arranged in nested relationship, with the side panels of adjacent wood connectors being in generally parallel relationship, and with the lateral panels of adjacent wood connectors being in generally parallel relationship; and connecting means cooperating with said plurality of nested wood connectors for effecting unitization thereof;

said bundles being arranged in layers, each of said layers comprising a plurality of connector bundles, and at least some of said layers being separated by a sheet material, wherein said bundles are oriented so that said lateral panels of said wood connectors are generally horizontal.

19. The connector bundle stack defined in claim 18, wherein said wood connectors are selected such that said connecting panels are substantially perpendicular to said lateral panels, and wherein said connector bundles are oriented in said layers so that said side panels are generally upright.

20. The connector bundle stack defined in claim 18, wherein each of said connector layers is separated from an adjacent connector layer by a sheet material.

21. The connector bundle stack defined in claim 18, further comprising means for enclosing said wood connector bundle layers.

22. The connector bundle stack defined in claim 21, wherein said stack-enclosing means comprises a heat-shrinkable polymer sheet.

23. A package of wood connector bundles, comprising:

a plurality of connector bundles, each of said connector bundles comprising:

a plurality of wood connectors, wherein each wood connector has a pair of substantially planar and generally parallel side panels, a pair of substantially planar and generally coplanar lateral panels, each of which is attached to be generally perpendicular to a respective one of said pair of side panels, and a generally planar connecting panel, with an end portion of each of said side panels being attached to a respective end portion of said connecting panel, the side panels extending from their corresponding connecting panel in a first direction, and with said wood connectors being arranged in nested relationship, with the side panels of adjacent wood connectors being in generally parallel relationship, and with the lateral panels of adjacent wood connectors being in generally parallel relationship; and connecting means cooperating with said plurality of nested wood connectors for effecting unitization thereof;

said bundles being arranged in layers, each of said layers comprising a plurality of connector bundles, and at least some of said layers being separated by a sheet material, wherein said bundles are oriented so that said lateral panels of said wood connectors are generally horizontal; and a pallet underlying said wood connector bundle stack.

24. The connector bundle stack defined in claim 23, wherein said wood connectors are selected such that said connecting panels are substantially perpendicular to said lateral panels, and wherein said connector bundles are oriented in said layers so that said side panels are generally upright.

25. The connector bundle stack defined in claim 23, wherein each of said connector layers is separated from an adjacent connector layer by a sheet material.

26. The connector bundle stack defined in claim 23, further comprising means for enclosing said wood connector bundle layers.

27. The connector bundle stack defined in claim 26, wherein said stack-enclosing means comprises a heat-shrinkable polymer sheet.

* * * * *

UNITED STATES PATENT AND TRADEMARK OFFICE

CERTIFICATE OF CORRECTION

PATENT NO. : 5,568,862

DATED : October 29, 1996

INVENTOR(S) : William H. Black, Jr.

It is certified that error appears in the above-identified patent and that said Letters Patent is hereby corrected as shown below:

On title page, item [56], add --3,180,489 4/1965 McGinn.....206/65--; replace "2,988,132" with --2,998,132--.

Column 10, line 64, replace "nails:" with --nails;--.

Signed and Sealed this

Twenty-fifth Day of March, 1997

Attest:

Attesting Officer

Bruce Lehman

BRUCE LEHMAN

Commissioner of Patents and Trademarks